US007571692B2

(12) United States Patent
Kreger

(10) Patent No.: US 7,571,692 B2
(45) Date of Patent: Aug. 11, 2009

(54) PERSONAL WATERCRAFT AND SEAT ASSEMBLIES THEREFOR

(75) Inventor: Laurence G. Kreger, Dublin, OH (US)

(73) Assignee: Honda Motor Company, Ltd., Tokyo (JP)

( * ) Notice: Subject to any disclaimer, the term of this patent is extended or adjusted under 35 U.S.C. 154(b) by 9 days.

(21) Appl. No.: 11/800,735

(22) Filed: May 7, 2007

(65) Prior Publication Data

US 2008/0276856 A1 Nov. 13, 2008

(51) Int. Cl.
*B63B 17/00* (2006.01)

(52) U.S. Cl. ..... 114/363; 114/55.57

(58) Field of Classification Search ..... 114/55.57, 114/363, 55.53

See application file for complete search history.

(56) References Cited

U.S. PATENT DOCUMENTS

| | | | | |
|---|---|---|---|---|
| 4,754,724 | A | 7/1988 | Murakami et al. | |
| 4,945,852 | A * | 8/1990 | Kobayashi | 114/363 |
| 5,282,437 | A | 2/1994 | Avillez de Basto | |
| 5,320,059 | A * | 6/1994 | Ikeda | 114/363 |
| 5,413,066 | A | 5/1995 | Spencer, Jr. et al. | |
| 5,570,654 | A * | 11/1996 | Rood | 114/363 |
| 5,676,086 | A * | 10/1997 | Watkins | 114/55.53 |
| 5,697,318 | A | 12/1997 | Kobayashi | |
| 5,964,172 | A | 10/1999 | Ikeda | |
| 6,021,734 | A * | 2/2000 | Sperberg | 114/363 |
| 6,041,732 | A * | 3/2000 | Ikeda | 114/363 |
| 6,145,458 | A * | 11/2000 | Hattori | 114/55.57 |
| 7,188,573 | B2 * | 3/2007 | Hirabara | 114/55.57 |
| 2002/0073910 | A1 | 6/2002 | Yamada et al. | |
| 2005/0016440 | A1 | 1/2005 | Simard et al. | |
| 2005/0212335 | A1 | 9/2005 | Johnson et al. | |

* cited by examiner

*Primary Examiner*—Lars A Olson
(74) *Attorney, Agent, or Firm*—Ulmer & Berne LLP

(57) ABSTRACT

A seat assembly is provided for a personal watercraft. The seat assembly includes a forward seat portion and a rearward seat portion. The forward seat portion is configured for fixed attachment to a deck of a personal watercraft. The forward seat portion is configured to contact and at least partially support an operator during driving of the personal watercraft. The rearward seat portion is selectively movable by an operator between a driving position and a fishing position. In the driving position, the rearward seat portion is adjacent to the forward seat portion. In the fishing position, the rearward seat portion is spaced from the forward seat portion. A personal watercraft including such a seat assembly is also provided.

18 Claims, 3 Drawing Sheets

PERSONAL WATERCRAFT AND SEAT ASSEMBLIES THEREFOR

TECHNICAL FIELD

The present invention relates to seat assemblies. More particularly, the present invention relates to seat assemblies for personal watercraft.

BACKGROUND

A conventional personal watercraft is commonly used for recreational driving and/or to facilitate transportation of an operator, and perhaps one or more passengers, from one location to another. A personal watercraft can additionally be employed in certain circumstances to facilitate transportation of cargo, and/or towing of persons or other watercraft. As compared to larger watercraft (e.g., ski boats or fishing boats), a personal watercraft can be smaller, less expensive, more fuel-efficient, more maneuverable, and easier to dock and transport. Accordingly, in light of these advantages, it can be desirable to employ a personal watercraft for an ever-increasing range of recreational and utilitarian functions that have conventionally been accomplished through use of larger watercraft.

SUMMARY

In accordance with one embodiment, a personal watercraft extends longitudinally from a forward end to a rearward end. The personal watercraft comprises a deck and a seat assembly. The seat assembly comprises a forward seat portion and a rearward seat portion. The forward seat portion is fixedly attached to the deck at a location longitudinally between the forward end and the rearward end. The forward seat portion comprises a seat surface configured to contact and at least partially support an operator during driving of the personal watercraft. The rearward seat portion is disposed at a location longitudinally between the forward seat portion and the rearward end. The rearward seat portion includes a support surface and is selectively movable by an operator between a driving position and a fishing position. In the driving position, the support surface is adjacent to and substantially continuous with the seat surface. In the fishing position, the support surface is spaced from the seat surface and is configured to contact and at least partially support a rearward-facing operator.

In accordance with another embodiment, a personal watercraft comprises a deck and a seat assembly. The seat assembly comprises a forward seat portion and a rearward seat portion. The forward seat portion is fixedly attached to the deck and is configured to contact and at least partially support an operator during driving of the personal watercraft. The rearward seat portion is selectively movable by an operator between a driving position in which the rearward seat portion is adjacent to the forward seat portion and a fishing position in which the rearward seat portion is spaced from the forward seat portion.

In accordance with yet another embodiment, a seat assembly is provided for a personal watercraft. The seat assembly comprises a forward seat portion and a rearward seat portion. The forward seat portion is configured for fixed attachment to a deck of a personal watercraft. The forward seat portion comprises a seat surface configured to contact and at least partially support an operator during driving of a personal watercraft. The rearward seat portion is configured for association with the forward seat portion at a location between the forward seat portion and a rearward end of a personal watercraft. The rearward seat portion includes a support surface and is selectively movable by an operator between a driving position and a fishing position. In the driving position, the support surface is adjacent to and substantially continuous with the seat surface. In the fishing position, the support surface is spaced from the seat surface and is configured to contact and at least partially support a rearward-facing operator.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION

Figure 1:
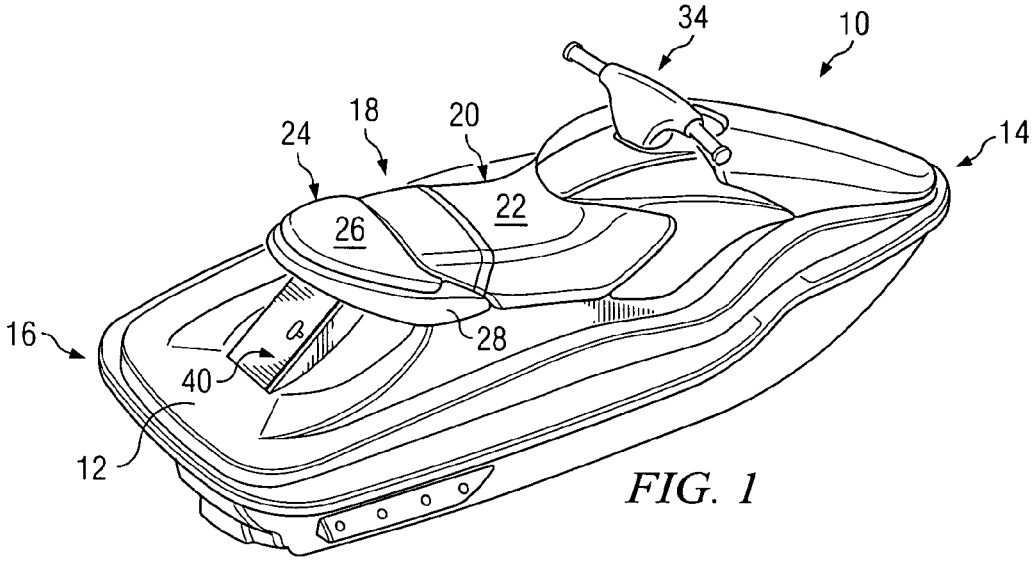
FIG. 1 is a rear perspective view depicting a personal watercraft having a seat assembly in accordance with one embodiment, wherein a rearward seat portion is in a driving position, and an access door is closed.

Referring to the figures in detail, wherein like numerals indicate similar elements throughout the views, FIGS. 1-7 illustrate a personal watercraft ("PWC") 10. The personal watercraft 10 is shown in FIGS. 1-7 to comprise a saddle-type vehicle having a seat assembly 18 which is configured to facilitate selective seating and/or other support of an operator and/or one or more passengers. The personal watercraft 10 is also shown to extend longitudinally from a forward end 14 to a rearward end 16, and to comprise a deck 12. A handlebar assembly 34 is shown to be pivotally attached with respect to the deck 12 to facilitate steering of the personal watercraft 10 by an operator (e.g., 90 in FIG. 5) of the personal watercraft 10. A fuel-driven engine and/or an electric propulsion system can also be provided upon the personal watercraft 10.

Figure 3:
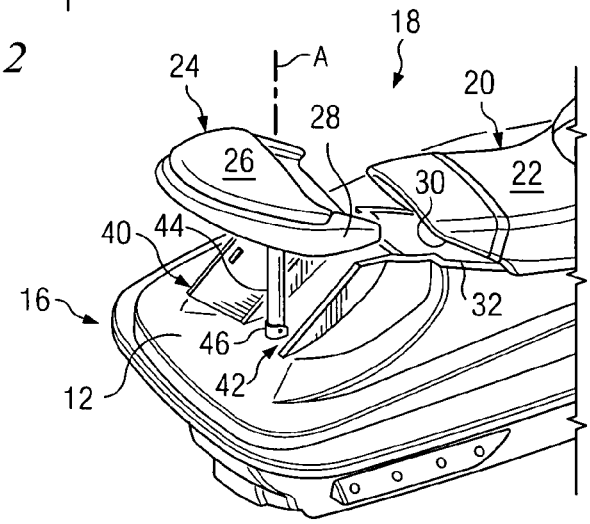
FIG. 3 is a rear perspective view depicting the portion of the personal watercraft of FIG. 2, wherein the rearward seat portion is shown to have been moved from the driving position to an intermediate position.
Figure 4:
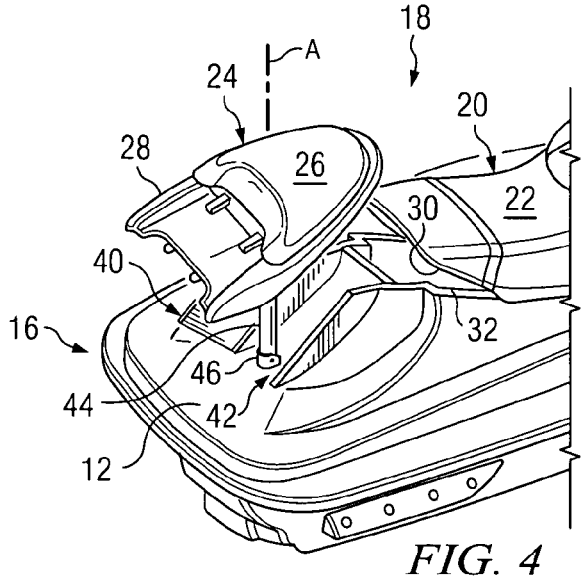
FIG. 4 is a rear perspective view depicting the portion of the personal watercraft of FIG. 3, wherein the rearward seat portion is shown to have been rotated from the intermediate position to a fishing position.
Figure 5:
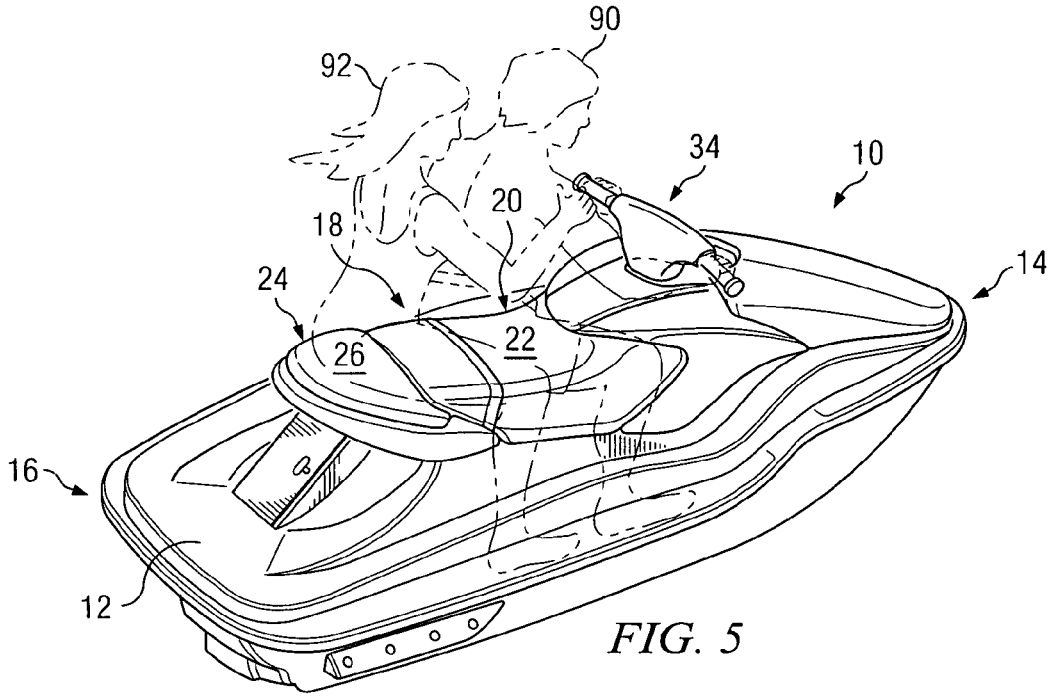
FIG. 5 is a rear perspective view depicting the personal watercraft of FIG. 1 having an operator and a passenger seated upon the seat assembly.

In one embodiment, as shown in FIGS. 1-7, the seat assembly 18 comprises a forward seat portion 20 and a rearward seat portion 24 which are associated with one another. The forward seat portion 20 is shown to be fixedly attached to the deck 12 at a location longitudinally between the forward end 14 and the rearward end 16. The forward seat portion 20 can comprise a seat surface 22 which is configured to contact and at least partially support an operator (e.g., 90, as shown in FIG. 5) during driving of the personal watercraft 10. The seat surface 22 might additionally be configured to contact and at least partially support a passenger (e.g., 92, as shown in FIG. 5) during driving of the personal watercraft 10. In one embodiment, the seat surface 22 can be cushioned to enhance comfort for an operator and/or passenger of the personal watercraft 10, and/or to facilitate enhanced friction between the seat surface 22 and the operator and/or passenger for holding them onto the personal watercraft 10 such as during motion of the personal watercraft 10. In one example, the seat surface 22 can comprise ultraviolet-resistant, marine-grade vinyl chloride polymer material, although it will be appreciated that the seat surface 22 might alternatively comprise any of a variety of other materials.

Figure 2:
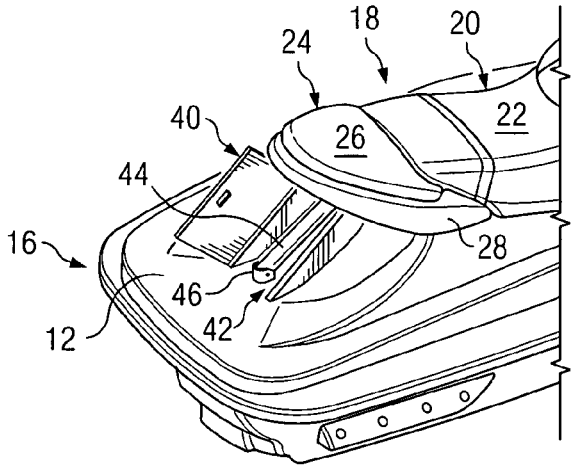
FIG. 2 is a rear perspective view depicting a portion of the personal watercraft of FIG. 1, wherein the rearward seat portion is in the driving position, and the access door is open.

The rearward seat portion 24 is shown to be disposed at a location longitudinally between the forward seat portion 20 and the rearward end 16. The rearward seat portion 24 can include a support surface 26 and can be selectively movable or otherwise movable by an operator between a driving position (shown in FIGS. 1-2 and 5) and a fishing position (shown in FIGS. 4 and 6-7). When in the driving position, the rearward seat portion 24 can be adjacent to the forward seat portion 20 such that the support surface 26 can support an operator 90 and/or one or more passengers (e.g., 92) of the personal watercraft 10, as shown in FIG. 5. In particular, when the rearward seat portion 24 is in the driving position, the support surface 26 can be adjacent to and substantially continuous with the seat surface 22, as shown in FIGS. 1-2 and 5.

Also, when the rearward seat portion 24 is in the driving position, the rearward seat portion 24 can interlock with the forward seat portion 20. In one particular embodiment, as shown in FIGS. 1-7, this interlock can be achieved by insertion of a lip portion 28 of the rearward seat portion 24 into a channel formed between a bottom edge 30 of the forward seat portion 20 and an upper edge 32 of the deck 12. However, it will be appreciated that a seat assembly can be configured such that a rearward seat portion selectively interlocks with a forward seat portion in any of a variety of alternative configurations.

Figure 6:
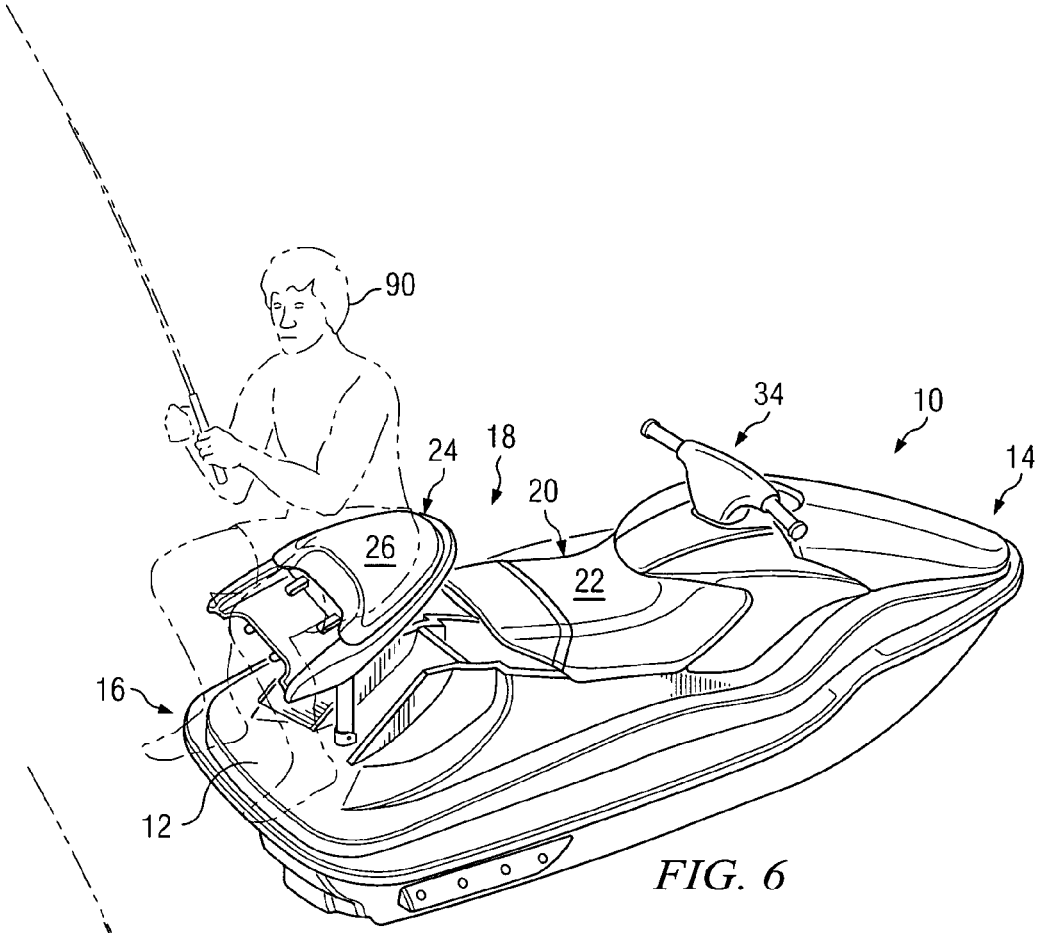
FIG. 6 is a rear perspective view depicting the personal watercraft of FIG. 1 having an operator seated upon the seat assembly.
Figure 7:
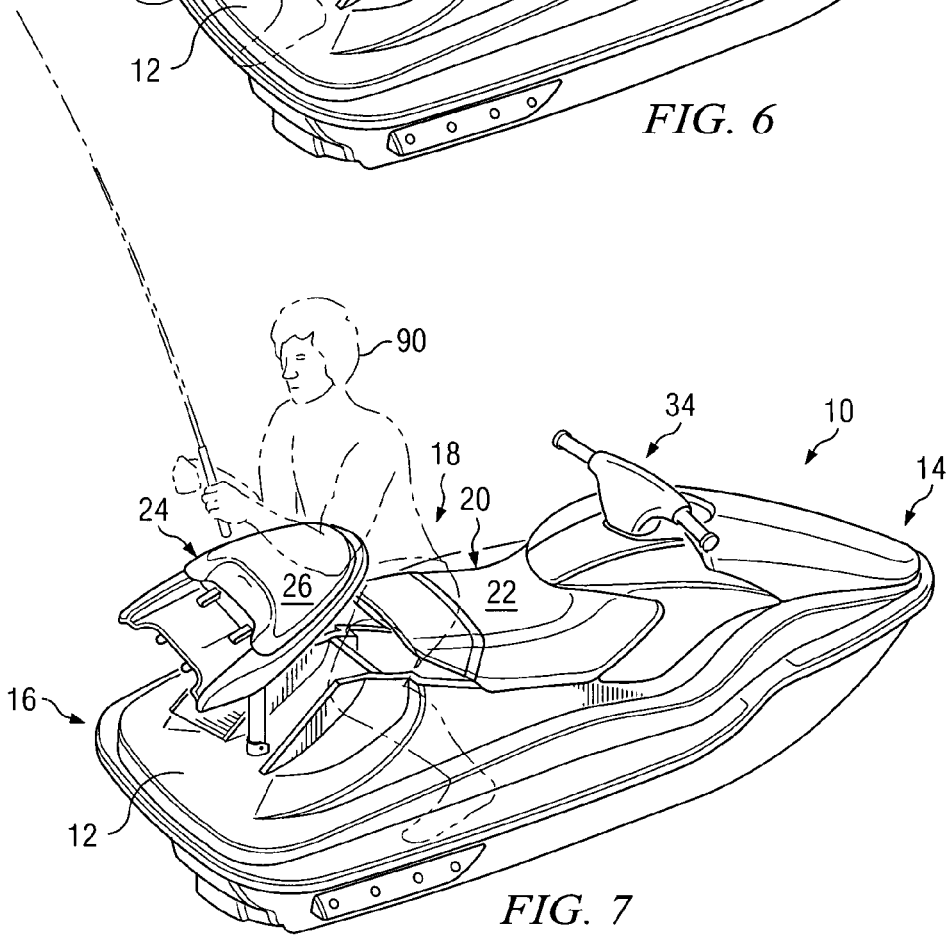
FIG. 7 is a rear perspective view depicting the personal watercraft of FIG. 1 wherein the rearward seat portion is in the fishing position and an operator is seated upon the seat assembly.

When in the fishing position, the rearward seat portion 24 can be spaced from the forward seat portion 20. In one embodiment, the support surface 26 can be spaced from the seat surface 22 and can be configured to contact and at least partially support a rearward-facing operator, as shown in FIGS. 4 and 6-7. In one embodiment, the support surface 26 can be cushioned to enhance comfort for an operator and/or passenger of the personal watercraft 10, and/or to facilitate enhanced friction between the support surface 26 and the operator and/or passenger for holding them onto the personal watercraft 10 such as during motion of the personal watercraft 10. In one example, the support surface 26 can comprise ultraviolet-resistant, marine-grade vinyl chloride polymer material, although it will be appreciated that the support surface 26 might alternatively comprise any of a variety of other materials.

When the rearward seat portion 24 is in the fishing position, the support surface 26 can provide an armrest for a rearward-facing operator 90 seated on the seat surface 22 (as shown in FIG. 7), or can alternatively provide a seat for a rearward-facing operator 90 (as shown in FIG. 6). The rearward seat portion 24 can alternatively support the rearward-facing operator 90 in any of a variety of other manners. Regardless of the manner in which the rearward seat portion 24 supports the rearward-facing operator 90, it will be appreciated that the rearward-facing operator 90 can be comfortably supported by the seat assembly 18 when fishing from the rearward end 16 of the personal watercraft 10. In one embodiment, as shown in FIGS. 4 and 6-7, in order to provide this comfort, the support surface 26 can be vertically elevated with respect to the seat surface 22 with respect to the deck 12 when the rearward seat portion 24 is in the fishing position.

The rearward seat portion 24 can be provided in any of a variety of configurations such that it may be movable with respect to the forward seat portion 20. In one embodiment, the rearward seat portion 24 can be movably attached to the deck 12. One such configuration is depicted in FIGS. 1-4. In particular, FIG. 1 depicts the rearward seat portion 24 as being in the driving position. An access door 40 is shown in FIG. 1 to be disposed beneath and behind the rearward seat portion 24, and to be in a closed position. In order to move the rearward seat portion 24 from the driving position, the access door 40 can be opened to reveal a chamber 42, as shown in FIG. 2. A support post 44 can be disposed within the chamber 42 and can be attached on one end to the deck 12 and on its other end to an underside of the rearward seat portion 24. When the rearward seat portion 24 is in the driving position, the support post 44 can be in an inclined position, as shown in FIG. 2.

However, when the rearward seat portion 24 is moved from the driving position and toward the rearward end 16 (e.g., to the intermediate position as shown in FIG. 3), the support post 44 can move from the inclined position to an upright position. Pivot brackets (e.g., 46) can be provided on one or both ends of the support post 44 to facilitate movement of the support post 44 from the inclined position to the upright position, and resultant longitudinal movement of the rearward seat portion 24 from the driving position (shown in FIG. 2) toward the rearward end 16 (e.g., to the intermediate position as shown in FIG. 3). In some circumstances, an operator might employ the rearward seat portion 24 for use in fishing while the rearward seat portion 24 resides in the intermediate position (shown in FIG. 3). However, in other circumstances, an operator might choose to rotate the rearward seat portion 24 about an axis "A" and from the intermediate position (shown in FIG. 3) and into the fishing position (shown in FIG. 4), and to then fish with the rearward seat portion 24 in the fishing position (as shown in FIGS. 6-7).

It will be appreciated that the support post 44, the pivot brackets (e.g., 46) and/or some other portion of the personal watercraft 10 can be configured to facilitate rotation of the rearward seat portion 24 about an axis "A" and from the intermediate position (shown in FIG. 3) and into the fishing position (shown in FIG. 4). Movement of the rearward seat portion 24 to the driving position from the fishing position or the intermediate position can be achieved by following a reverse sequence of activities as will be appreciated. Once the rearward seat portion 24 is returned to the driving position, the access door 40 can be closed to conceal the chamber 42, the support post 44, and the pivot brackets (e.g., 46), for example.

In one embodiment, as shown in FIGS. 1-4, the access door 40 can be hingedly attached to the deck 12 and can include a handle or other catch to facilitate selective locking of the access door 40 in the closed position (shown in FIG. 1) such that the access door 40 does not inadvertently open during driving of the personal watercraft 10. It will be appreciated that the chamber 42 and/or some other integral compartment on the personal watercraft 10 can be configured to selectively store items, such as fishing gear, during travel of the personal watercraft 10 from a dock to the intended fishing location. The personal watercraft 10 can also be provided with any of a variety of other accessories to facilitate convenient fishing. Such accessories can include, for example, one or more fishing pole holders, a live well, drink holders, a cooler, a power accessory receptacle, and/or movable foot, arm and/or back rests to comfortably support an operator and/or passenger(s).

It will be appreciated that the support post 44, the pivot brackets (e.g., 46) and/or some other portion of the personal watercraft 10 may include locking members to selectively lock the rearward seat portion 24 in either the driving position (shown in FIG. 2), the intermediate position (shown in FIG. 3), and/or the fishing position (shown in FIG. 4). An operator of the personal watercraft 10 can adjust these locking members to selectively retain the rearward seat portion 24 in one or more positions, and/or to selectively release the rearward seat portion 24 from a position. A locking member may comprise, for example, a pin, a hook, a catch, a slide, a lever, a knob, and/or any of a variety of other devices or arrangements. It will also be appreciated that the support post 44, the pivot brackets (e.g., 46) and/or some other portion of the personal watercraft 10 can facilitate an operator's adjustment of swivel (about axis "A"), tilt (perpendicular to axis "A"), and/or height (along axis "A") of the rearward seat portion 24 with respect to the deck 12 to achieve optimal comfort of the operator while fishing. In another embodiment, a rearward seat portion might be selectively detachable from the deck of a personal watercraft to facilitate movement between and connection of the rearward seat portion to the deck of the personal watercraft in both a driving position and a fishing position.

In addition to being configured to selectively serve as an effective fishing vessel, it will be appreciated that the personal watercraft 10 can be effectively employed for any of the uses typical of conventional personal watercraft. For example, the personal watercraft 10 can be selectively used for recreational driving and/or to facilitate transportation of an operator, and perhaps one or more passengers, from one location to another. The personal watercraft 10 can additionally be employed in certain circumstances to facilitate transportation of cargo, and/or towing of persons or other watercraft. In other embodiments, a personal watercraft can be provided in any of a variety of configurations other than that depicted in FIGS. 1-7.

The foregoing description of embodiments and examples has been presented for purposes of illustration and description. It is not intended to be exhaustive or to limit the invention to the forms described. Numerous modifications are possible in light of the above teachings. Some of those modifications have been discussed, and others will be understood by those skilled in the art. The embodiments were chosen and described in order to best illustrate various embodiments as are suited to the particular use contemplated. It is hereby intended that the scope of the invention be defined by the claims appended hereto.

What is claimed is:

1. A personal watercraft extending longitudinally from a forward end to a rearward end, the personal watercraft comprising:

a deck; and a seat assembly comprising:

a forward seat portion fixedly attached to the deck at a location longitudinally between the forward end and the rearward end, the forward seat portion comprising a seat surface configured to contact and at least partially support an operator during driving of the personal watercraft; and a rearward seat portion disposed at a location longitudinally between the forward seat portion and the rearward end, the rearward seat portion including a support surface and being selectively movable by an operator between a driving position and a fishing position, in which driving position the support surface is adjacent to and substantially continuous with the seat surface, and in which fishing position the support surface is spaced from the seat surface and is configured to contact and at least partially support a rearward-facing operator; wherein the rearward seat portion is selectively rotatable about an axis, the axis being generally vertical when the rearward seat portion is in the fishing position.

2. The personal watercraft of claim 1 wherein the rearward seat portion is configured such that, in moving from the driving position to the fishing position, the rearward seat portion moves longitudinally toward the rearward end.

3. The personal watercraft of claim 1 wherein each of the seat surface and the support surface is cushioned.

4. The personal watercraft of claim 3 wherein each of the seat surface and the support surface comprises ultraviolet-resistant, marine-grade vinyl chloride polymer material.

5. The personal watercraft of claim 1 wherein the rearward seat portion is configured such that, when in the driving position, the support surface is configured to support at least one of an operator and a passenger.

6. The personal watercraft of claim 1 being configured such that, when the rearward seat portion is in the driving position, the rearward seat portion interlocks with the forward seat portion.

7. The personal watercraft of claim 1 wherein the rearward seat portion is movably attached to the deck.

8. The personal watercraft of claim 1 being configured such that, when the rearward seat portion is in the fishing position, the support surface is adapted to seat a rearward-facing operator.

9. The personal watercraft of claim 1 wherein:

the support surface is vertically elevated with respect to the seat surface when the rearward seat portion is in the fishing position.

10. A personal watercraft extending longitudinally from a forward end to a rearward end, the personal watercraft comprising:

a deck; and a seat assembly comprising:

a forward seat portion fixedly attached to the deck at a location longitudinally between the forward end and the rearward end, the forward seat portion comprising a seat surface configured to contact and at least partially support an operator during driving of the personal watercraft; and a rearward seat portion disposed at a location longitudinally between the forward seat portion and the rearward end, the rearward seat portion including a support surface and being selectively movable by an operator between a driving position and a fishing position, in which driving position the support surface is adjacent to and substantially continuous with the seat surface, and in which fishing position the support surface is spaced from the seat surface and is configured to contact and at least partially support a rearward-facing operator;

wherein the support surface is vertically elevated with respect to the seat surface when the rearward seat portion is in the fishing position, the personal watercraft being configured such that, when the rearward seat portion is in the fishing position, the support surface is adapted to provide an armrest for a rearward-facing operator seated on the seat surface.

11. A personal watercraft comprising:

a deck; and a seat assembly comprising:

a forward seat portion fixedly attached to the deck and configured to contact and at least partially support an operator during driving of the personal watercraft; and a rearward seat portion selectively movable by an operator between a driving position in which the rearward seat portion is adjacent to the forward seat portion and a fishing position in which the rearward seat portion is spaced from the forward seat portion; wherein the rearward seat portion is selectively rotatable about an axis, the axis being generally vertical when the rearward seat portion is in a fishing position.

12. A seat assembly for a personal watercraft, the seat assembly comprising:

a forward seat portion configured for fixed attachment to a deck of a personal watercraft, the forward seat portion comprising a seat surface configured to contact and at least partially support an operator during driving of a personal watercraft; and a rearward seat portion configured for association with the forward seat portion at a location between the forward seat portion and a rearward end of a personal watercraft, the rearward seat portion including a support surface and being selectively movable by an operator between a driving position and a fishing position, in which driving position the support surface is adjacent to and substantially continuous with the seat surface, and in which fishing position the support surface is spaced from the seat surface and is configured to contact and at least partially support a rearward-facing operator; wherein the rearward seat portion is selectively rotatable about an axis, the axis being generally vertical when the rearward seat portion is in the fishing position.

13. The seat assembly of claim 12 wherein each of the seat surface and the support surface is cushioned.

14. The seat assembly of claim 13 wherein each of the seat surface and the support surface comprises ultraviolet-resistant, marine-grade vinyl chloride polymer material.

15. The seat assembly of claim 12 wherein the rearward seat portion is configured such that, when in the driving position, the support surface is configured to support at least one of an operator and a passenger.

16. The seat assembly of claim 12 being configured such that, when the rearward seat portion is in the driving position, the rearward seat portion interlocks with the forward seat portion.

17. The seat assembly of claim 12 wherein the rearward seat portion is configured for movable attachment to a deck of a personal watercraft.

18. A seat assembly for a personal watercraft, the seat assembly comprising:

a forward seat portion configured for fixed attachment to a deck of a personal watercraft, the forward seat portion comprising a seat surface configured to contact and at least partially support an operator during driving of a personal watercaft; and a rearward seat portion configured for association with the forward seat portion at a location between the forward seat portion and a rearward end of a personal watercraft, the rearward seat portion including a support surface and being selectively movable by an operator between a driving position and a fishing position, in which driving position the support surface is adjacent to the seat surface, and in which fishing position the support surface is spaced from the seat surface and is configured to contact and at least partially support a rearward-facing operator; wherein the support surface is vertically elevated with respect to the seat surface when the forward seat portion is in the fishing position; and the rearward seat portion is selectively rotatable about an axis, the axis being generally vertical when the rearward seat portion is in the fishing position.

* * * * *

UNITED STATES PATENT AND TRADEMARK OFFICE

CERTIFICATE OF CORRECTION

PATENT NO. : 7,571,692 B2
APPLICATION NO. : 11/800735
DATED : August 11, 2009
INVENTOR(S) : Laurence G. Kreger It is certified that error appears in the above-identified patent and that said Letters Patent is hereby corrected as shown below:

Claim 18, Column 8, line 19, change "watercaft" to --watercraft--.

Claim 18, Column 8, line 33, change "forward" to --rearward--.

Signed and Sealed this

Sixth Day of October, 2009

David J. Kappos

David J. Kappos
*Director of the United States Patent and Trademark Office*